US010072398B2

(12) United States Patent
Magill et al.

(10) Patent No.: US 10,072,398 B2
(45) Date of Patent: Sep. 11, 2018

(54) OUTDOOR WATER SERVICE ENCLOSURE AND SYSTEM

(71) Applicant: Ion Irrigation Management Inc., Calgary (CA)

(72) Inventors: Michael Magill, Calgary (CA); Casey Mahan, Calgary (CA); Chad Placsko, Okotoks (CA)

(73) Assignee: Ion Irrigation Management Inc., Calgary (CA)

( * ) Notice: Subject to any disclaimer, the term of this patent is extended or adjusted under 35 U.S.C. 154(b) by 0 days.

(21) Appl. No.: 15/582,977

(22) Filed: May 1, 2017

(65) Prior Publication Data

US 2017/0314239 A1 Nov. 2, 2017

(30) Foreign Application Priority Data

May 2, 2016 (CA) ..... 2928763

(51) Int. Cl.
*E03B 7/07* (2006.01)
*E03B 7/12* (2006.01)
*E03B 7/09* (2006.01)

(52) U.S. Cl.
CPC ..... *E03B 7/095* (2013.01); *E03B 7/078* (2013.01); *E03B 7/12* (2013.01)

(58) Field of Classification Search
CPC ..... E03B 7/095; E03B 7/078; E03B 7/12
See application file for complete search history.

(56) References Cited

U.S. PATENT DOCUMENTS 2,274,106 A * 2/1942 Strong ..... H02B 1/28 312/100
2,649,825 A * 8/1953 Fisher ..... B25B 13/48 29/213.1
2,694,454 A * 11/1954 Eickmeyer ..... A62C 99/009 169/13
3,162,863 A * 12/1964 Wokas ..... E04B 1/34869 4/211
3,397,500 A * 8/1968 Watson, Jr. ..... E04B 2/60 52/282.1
3,449,838 A * 6/1969 Chancellor, Jr. ..... A45D 20/16 312/227

(Continued)

FOREIGN PATENT DOCUMENTS

CA 2015672 8/1994
CA 2058523 12/1996

(Continued)

*Primary Examiner* — Jeanette E Chapman
(74) *Attorney, Agent, or Firm* — Stradley Ronon Stevens & Young, LLP

(57) ABSTRACT

An outdoor water service system is described. The system is primarily for providing water for outdoor applications in cold weather, such as flooding outdoor rinks but may also be used for other watering applications in warmer weather. The system includes a source of water connected to an underground hydrant with an above-ground hydrant valve and a heated enclosure with a floor and an opening in the floor through which the hydrant valve extends. The enclosure includes a hose, a heater, a water conduit extending from the hydrant valve to the hose, a first door for accessing the hydrant valve from outside of the enclosure and a second door for accessing the hose.

8 Claims, 8 Drawing Sheets

(56) References Cited

U.S. PATENT DOCUMENTS 3,596,768 A * 8/1971 Whitten, Jr. ..... 210/167.31
4,947,025 A 8/1990 Alston et al.
5,568,824 A 10/1996 Cordey
5,909,983 A * 6/1999 McGee, Jr. ..... A62C 35/026 169/13
6,454,424 B1 * 9/2002 Tobin ..... H01R 25/006 362/154
6,474,410 B1 11/2002 Minich et al.
6,481,448 B2 * 11/2002 Mathieu ..... B08B 3/026 134/109
6,532,985 B1 * 3/2003 Griffin ..... E03B 7/077 137/341
8,097,451 B2 * 1/2012 Gaalswyk ..... C12M 21/12 202/83
8,253,073 B2 8/2012 Marcotte
8,439,651 B2 5/2013 Gilpatrick
8,888,199 B2 * 11/2014 Vogl ..... E04H 1/1205 312/310
8,998,284 B1 * 4/2015 Minahan ..... A01K 97/01 135/901
9,028,298 B2 5/2015 Seyffert
2002/0002985 A1 * 1/2002 Mathieu ..... B08B 3/026 134/10
2003/0019031 A1 1/2003 Mosis
2004/0036628 A1 * 2/2004 Leigh ..... B64F 1/20 340/908
2005/0016608 A1 * 1/2005 Smith ..... F16L 55/165 138/98
2005/0045228 A1 * 3/2005 Labrador ..... E03B 1/02 137/357
2008/0111659 A1 * 5/2008 Pesapane ..... G07C 9/00103 340/5.6
2010/0065287 A1 * 3/2010 Burkhart ..... A62C 35/58 169/17
2010/0270221 A1 * 10/2010 Reardon ..... E21B 21/062 210/178
2012/0097590 A1 * 4/2012 Early ..... C02F 3/1242 210/198.1
2013/0193231 A1 * 8/2013 Mologousis ..... B05B 15/06 239/172
2015/0097001 A1 4/2015 Gatipon
2015/0150215 A1 6/2015 Pumphrey
2015/0282349 A1 * 10/2015 Mann ..... H05K 5/0217 312/283
2017/0022992 A1 * 1/2017 Jutras ..... A62C 25/00

FOREIGN PATENT DOCUMENTS

GB 2274704 A * 8/1994 ..... F24D 3/1008
JP 2005282282 10/2005
JP 2006083434 A * 3/2006

* cited by examiner

OUTDOOR WATER SERVICE ENCLOSURE AND SYSTEM

CROSS-REFERENCE TO RELATED APPLICATIONS

This application claims priority to Canadian Patent Application CA 2,928,763, filed on May 2, 2016, the entire disclosure of which is incorporated herein by reference in its entirety.

FIELD OF THE INVENTION

The invention relates to generally to the field of water service systems and more specifically to outdoor water service systems designed to protect the components thereof from damage due to freezing of water in cold weather.

BACKGROUND OF THE INVENTION

Cold weather outdoor watering is required in a number of situations such as livestock watering and flooding of outdoor skating/hockey rinks. The provision of a water service system for such applications is often problematic because hoses must often be located in warm structures considerable distances from where they are used, and can often freeze during the time it takes to move and set up the hose for watering. Since out-buildings more often have electrical service than are heated, often the only feasible options for watering livestock or flooding rinks include either expensive permanent installations or water delivery.

With respect to outdoor rinks, this problem is often addressed by transporting significant volumes of water to each rink in a water truck or a driving a mobile ice resurfacing machine (most typically known as a Zamboni) to the rink. These options are expensive and require trained individuals for operation of specialized equipment. Other solutions include water hook-ups to residential water sources or water sources which are installed at parks as dedicated sources for irrigation and/or rink flooding. Residential water sources are inconvenient and municipal dedicated water sources tend to be subjected to mistreatment by users, resulting in freezing of water lines and destruction of the associated equipment.

A number of references have described efforts to solve certain aspects of problems relating to outdoor water and electrical service systems. For example, Canadian Patent 2015672 (incorporated herein by reference in its entirety) describes an apparatus designed to be carried on a vehicle to locations of above-ground hydrants for the purpose of thawing water contained therein. The apparatus is an insulated cabinet with a plurality of doors providing interior access. It contains a water reservoir tank, water heater, a suction hose and delivery hose to provide warm water to the hydrant. The hose is preferably mounted on a powered reel.

Canadian Patent 2058523 (incorporated herein by reference in its entirety) describes a water piping system for withdrawing water from a hose to prevent proliferation of bacteria and preventing damage to pipes in the winter. The system includes a housing with a valve for controlling the water flow, a heater to prevent valve damage, a flowmeter, and a hose.

Japanese Patent 2005282282 (incorporated herein by reference in its entirety) describes a storage cabinet for a garden hose which includes a valve housed in the cabinet which includes an upper sink and tap. The hose is wound on a reel located on rails which allows the reel to be withdrawn from the cabinet.

U.S. Pat. No. 4,947,025 (incorporated herein by reference in its entirety) describes a portable electric water heater designed for outdoor use. The device includes an impact resistant waterproof housing with an access door and a coiled water conducting copper tube wrapped with an electrical resistance heating element. The housing includes wheels and legs and a handle that facilitates movement of the device. The coiled tube is connectable to a hose for providing heated water.

U.S. Pat. No. 5,568,824 (incorporated herein by reference in its entirety) describes a hose reel with a housing or casing for providing concealed installation of the hose with the ground or in a basement or crawlspace. A hose access and control panel is also provided. The housing is heated to prevent freezing of the hose and the reel assembly may be mounted on tracks for withdrawal from the assembly. The housing includes a separate electrical compartment and the valve for controlling water flow is housed within the compartment.

U.S. Pat. No. 6,474,410 (incorporated herein by reference in its entirety) describes a portable sealed waterproof and ozone-proof apparatus for housing electronics devices for outside use. The apparatus includes electrical outlets, a heater and sliding shelves for holding electronics devices such as a TV, VCR, DVD, stereo etc. The apparatus is on lockable wheels and has handles to facilitate movement.

U.S. Pat. No. 8,253,073 (incorporated herein by reference in its entirety) describes a hose heater for use in outdoor or unheated interior spaces of a home, construction office or farm. The hose heater includes an enclosure having a hose reel for storing the hose also having an electrical heating unit to warm the stored hose between uses. A heating core located in the center of the reel provides heat, keeping the hose from freezing. The enclosure which itself may be heated or unheated, blankets the hose to provide heat to the outer hose coils to ensure that the extremities are maintained at a freeze-free temperature. This device can be used in small scale farming, outside use, and other areas where animals and ice rinks need watering in winter with a hose.

U.S. Pat. No. 8,439,651 (incorporated herein by reference in its entirety) describes a portable booster pump system, for boosting a flow of water from a water source, includes a housing having a retractable handle. The booster pump system also includes a water pump positioned within the housing. The booster pump system further includes a hose reel positioned within the housing, where the hose reel supports a garden hose attached to the outlet of the pump.

U.S. Pat. No. 9,028,298 (incorporated herein by reference in its entirety) describes a pressurized dual fluid jet system for fighting fires. The system includes a portable housing with compartmentalized sections and with a hose reel, gauges, a control panel and check valve.

US Patent Application Publication No. 20030019031 (incorporated herein by reference in its entirety) describes a portable sink based on a cabinet having doors to access the interior of the cabinet, an external water connection, a heater, a power cord with an electrical outlet and a check valve.

US Patent Application Publication No. 20150097001 (incorporated herein by reference in its entirety) describes a mobile beverage cart based on a portable cabinet with separate component compartments (including a utility compartment) a refrigeration system, a power cord, access doors and a hose reel.

US Patent Application Publication No. 20150150215 (incorporated herein by reference in its entirety) describes an automatic system for watering livestock which includes an upper trough in an enclosure with a heating system to prevent water from freezing during cold weather.

A need exists for improvements over water service systems which provide enhanced capabilities at low cost and convenience.

SUMMARY OF THE INVENTION

In accordance with one aspect of the invention, there is provided an outdoor water service system comprising: a) a source of water connected to an underground hydrant with an above-ground hydrant valve; and b) an enclosure with a floor and an opening in the floor through which the hydrant valve extends; the enclosure further comprising: i) a hose; ii) a heater; iii) a water conduit extending from the hydrant valve to the hose; iv) a first door for accessing the hydrant valve from outside of the enclosure; and v) a second door for accessing the hose from outside of the enclosure.

In certain embodiments, the system further comprises a backflow preventer located in the water conduit between the hydrant valve and the hose.

In certain embodiments, the enclosure includes a third door for accessing the backflow preventer.

In certain embodiments, the second door includes a hose opening allowing withdrawal of the hose from the enclosure when the second door is closed.

In certain embodiments, the enclosure is divided into at least two compartments, wherein the hydrant valve and the backflow preventer are located in a first compartment and the hose is located in a second compartment, and wherein the first compartment and the second compartment are both heated by an internal heater located in either the first compartment or the second compartment.

In certain embodiments, system further comprises a third compartment for holding an electrical control panel for providing electricity to one or more components located inside or outside of the enclosure, the third compartment accessible by a fourth door in the enclosure.

In certain embodiments, the one or more components include at least the internal heater and/or one or more components selected from the group consisting of: a water pump, an outdoor light, an outdoor heater, an outdoor security camera, a public address system, an irrigation system, and an outdoor television screen.

In certain embodiments, the enclosure is supported by a pad resting on the ground, the pad defined by an opening allowing passage of the hydrant therethrough.

In certain embodiments, the enclosure further comprises a fifth door for accessing a hose valve controlling the flow of water into the hose.

In certain embodiments, the hose is spooled on a hose reel.

Another aspect of the invention is an enclosure for an outdoor water service system, the enclosure comprising: a) a first compartment with a bottom opening providing an entrance for an above-ground portion of an underground hydrant which includes an above-ground hydrant valve, the first compartment having a first door for providing access to the hydrant valve located in the first compartment when the enclosure is operating in the water service system; and b) a second compartment adjacent to the first compartment, the second compartment having sufficient space to hold a hose when the enclosure is operating in the water service system, the second compartment provided with a second door having sufficient area to allow withdrawal of the hose from the second compartment, wherein either the first or second compartments are configured for installation of a heater to heat both the first and second compartments.

In certain embodiments, the enclosure further comprises a third door located in the first compartment, the third door for accessing one or more water utility components contained in the first compartment when the enclosure is operating in the water service system.

In certain embodiments, the enclosure further comprises a third compartment having sufficient space to hold an electrical control panel, the third compartment having a fourth door for accessing the control panel in the third compartment when the enclosure is operating in the water service system.

In certain embodiments, the enclosure further comprises a fifth door in the first compartment for accessing a hose valve in the first compartment when the enclosure is operating in the water service system.

In certain embodiments, the second door includes a hose opening allowing withdrawal of the hose from the enclosure when the second door is closed, and when the enclosure is operating in the water service system.

In certain embodiments, a wall separating the second and third compartments has a cut-out portion for at least partially supporting the heater when the enclosure is operating in the water service system.

In certain embodiments, an outer wall of the third compartment has an opening for holding an electrical meter when the enclosure is operating in the water service system.

In certain embodiments, the second compartment includes a hose reel frame system configured to support a hose reel and allow removal of the hose reel from the second compartment via the second door when the enclosure is operating in the water service system.

In certain embodiments, the hose reel frame system is configured to be raised to the level of the second door's frame.

In certain embodiments, the enclosure is constructed of inner and outer walls formed of aluminum.

In certain embodiments, the enclosure further includes insulation between the inner and outer walls.

Another aspect of the invention is a kit for assembly of an outdoor water service system, the kit comprising: a) an enclosure as recited herein; and b) instructions for assembly of the system.

In certain embodiments, the kit further comprises at least a hydrant, a hose, a hose reel, one or more lengths of water conduit, and a heater.

In certain embodiments, the kit further comprises a backflow preventer.

In certain embodiments, the kit further comprises an electrical control panel.

BRIEF DESCRIPTION OF THE DRAWINGS

Various objects, features and advantages of the invention will be apparent from the following description of particular embodiments of the invention, as illustrated in the accompanying drawings. The drawings are not drawn to scale in all cases. Instead, emphasis is placed upon illustrating the principles of various embodiments of the invention. Similar reference numerals indicate similar components.

DETAILED DESCRIPTION OF THE INVENTION

Rationale

Figure 1:
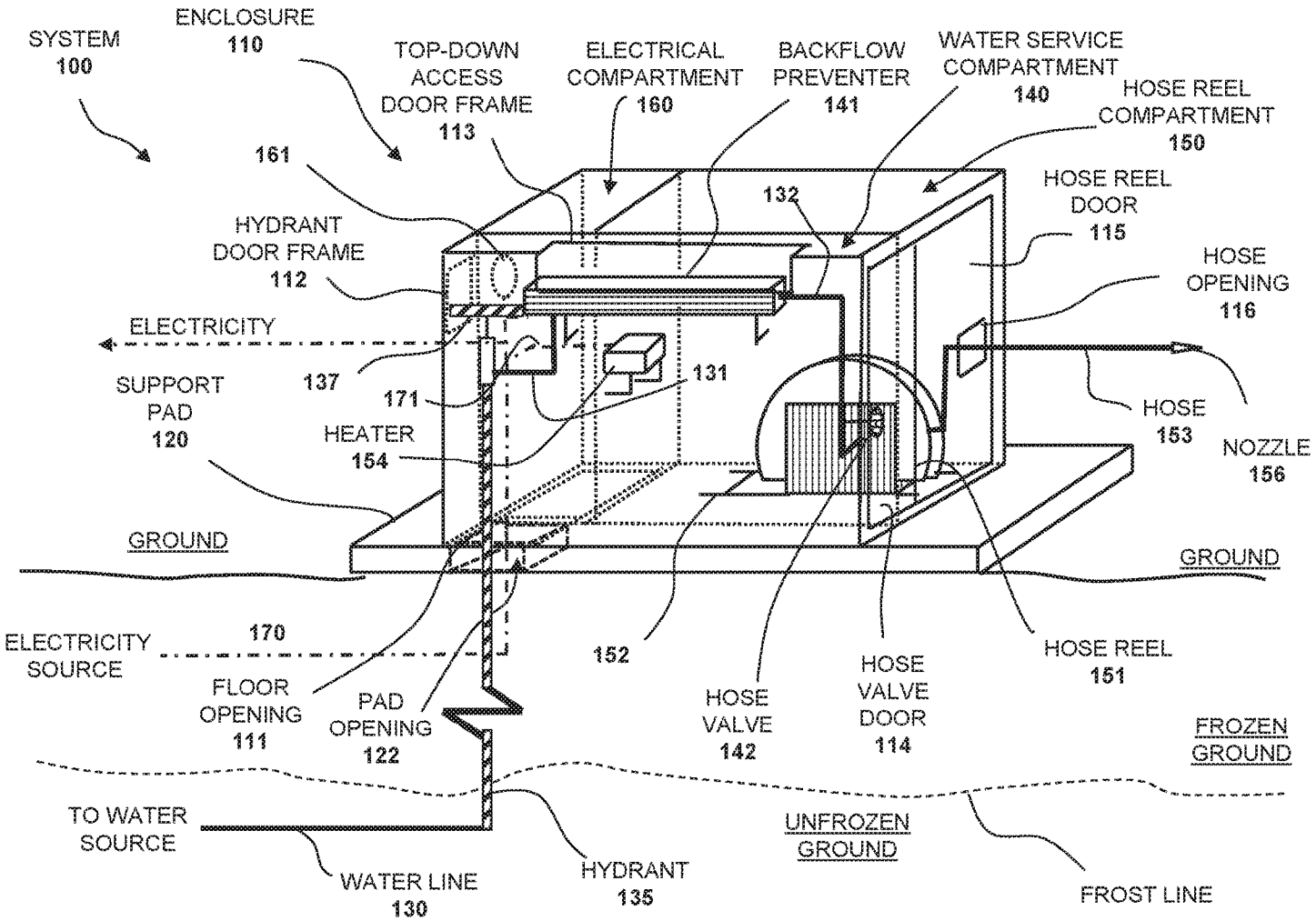
FIG. 1 is a schematic perspective view of one system embodiment 100.

The present inventors have recognized that there are a number of shortcomings in the various water service systems used to provide water for flooding outdoor rinks. The wide range of current solutions include transportation of water by vehicles and water hook-ups to residential water sources or water sources which are installed at parks as dedicated sources for irrigation and/or rink flooding. Residential water sources are inconvenient and municipal dedicated water sources tend to be subjected to mistreatment by users, resulting in freezing of water lines and destruction of the associated equipment. The present technology was conceived and designed to address these problems.

Water Service Enclosure and System

Various aspects of the invention will now be described with reference to the figures. For the purposes of illustration, components depicted in the figures are not necessarily drawn to scale in all cases. Instead, emphasis is placed on highlighting the various contributions of the components to the functionality of various aspects of the invention. A number of possible alternative features are introduced during the course of this description. It is to be understood that, according to the knowledge and judgment of persons skilled in the art, such alternative features may be substituted in various combinations to arrive at different embodiments of the present invention.

One embodiment of an outdoor water service system configured for operation in cold weather is now described with reference to FIG. 1. An embodiment of the enclosure of the invention is also described below, with reference to FIGS. 2-6. Lastly, another embodiment of the system is described with reference to FIG. 7 and a plan view of the support pad for the enclosure system of FIG. 7 is described with reference to FIG. 8. Similar reference numerals are used to refer to similar features, wherever possible.

Turning now to FIG. 1, there is shown one embodiment of an outdoor water service system 100 which includes an enclosure 110 sitting upon a support pad 120 resting on the ground. The enclosure has a number of doors which in most cases are simply depicted in FIG. 1 as frames for the sake of preserving clarity (with the exception of the hose valve door 114 and the hose reel door 115, the latter which is depicted as a door in order to show the location of the hose opening 116).

The support pad 120 includes a central opening (not shown) to allow drainage of water from the floor of the enclosure to the ground. The enclosure 110 is supplied with water via a water line 130 connected to a source such as a municipal water source for example. In other embodiments, the water source is a body of water connected to the enclosure with a water line and a pump which may be housed inside the enclosure 110. A hydrant 135 is connected to the water line 130. In this particular embodiment, the depth of the frost line is estimated and the lowest end of the hydrant 135 is located below this level to ensure that water will drain out of the upper part of the hydrant 135 to prevent freezing of water in the hydrant 135. In some embodiments, the hydrant 135 is designed and manufactured for use in cold weather such as snow-making operations. Examples of such hydrants are manufactured and sold by Roger's Hydrant Company of Colorado Springs, Colo., USA; (http://www.rogershydrants.com, incorporated herein by reference in its entirety) and which are available in a range of lengths. These hydrants include valves which allow excess water to drain into the ground, eliminating the possibility of any part of the hydrant freezing shut.

The upper part of the hydrant 135 extends through an opening 122 in the support pad 120 and through a floor opening 111 in the enclosure 110. Opening and closing of the hydrant 135 is controlled at a hand-operated hydrant valve 137 which is located inside the enclosure 110 in the front left corner in the view of FIG. 1. Access to the hydrant valve 137 is gained through a hydrant door whose frame is shown at 112. A door is fitted and pivotally attached to the hydrant door frame 112 in a conventional manner. The arrangement of the enclosure 110 on the support pad 120 and the water line passing through the pad opening 120 is advantageous because freeze thaw cycles cause ground surface movements which can cause buckling and cracking of hard surfaces on the ground, as known from common frost cracks in roads and sidewalks. The system 100 will not be affected by such ground movements because the support pad 120 can move with ground movements without translating such movements to the water line 130 provided that the pad opening 122 has sufficient area to prevent contact of the water line with the sidewalls thereof.

It is seen in FIG. 1 that the interior of enclosure 110 is divided into three compartments which are indicated by broken lines. There is a water service compartment 140 which spans the length of the front of the enclosure 110. This water service compartment 140 is seen at the front of the perspective view of FIG. 1. The floor opening 111, main water line 130 and hydrant valve 137 are located in the water service compartment 140. A water branch line 131 extends from the hydrant 135 to a backflow preventer 141 whose function is to prevent water within downstream conduits contained within the enclosure 110 from flowing back to the water source. The backflow preventer 141 thus protects the water source from contamination with microorganisms which may be present in the water conduits 131 and 132 of the enclosure 110.

The backflow preventer 141 is located near the top of the water service compartment 140. Backflow preventers are known in the art and are adaptable for use with various embodiments of the present invention. A top-down access door frame 113 is provided centrally at the corner of the front wall and the top wall of the enclosure in the perspective shown in FIG. 1. This top-down access door frame 113 is provided to allow the backflow preventer 141 to be serviced in a convenient manner and is covered by a door (not shown in FIG. 1) in a conventional manner. Another water conduit 132 is shown leading from the backflow preventer 141 to a hand-operated hose valve 142 which is accessed via a hose valve door frame 114 located in the right side wall in the orientation shown in FIG. 1. Water conduit 132 exits the water service compartment through an opening (not shown) in the wall panel in the interior of the enclosure 110.

With respect to the orientation of the system 100 shown in FIG. 1, the interior of the enclosure 110 behind the water service compartment 140 is divided into two additional compartments. The larger of the two compartments is the hose reel compartment 150. The main component of the hose reel compartment 150 is the hose reel 151 which is installed on a hose reel frame 152. In this particular embodiment, the hose reel frame 152 is provided with the capability to raise the hose reel 151 to be level with the hose reel frame 152. This allows the entire hose reel 151 to be withdrawn from the enclosure 110 through a hose reel door 115 located in the right wall of the enclosure in the orientation shown in FIG. 1. In this manner, the hose 153 and/or the hose reel 151 may be easily accessed for maintenance, repair or replacement.

In this particular embodiment the hose reel door 115 is provided with a hose opening 116 which allows the hose reel to remain inside the hose reel compartment 150. This is desirable if the outdoor temperature is cold enough to freeze water in a hose. In certain embodiments, the hose opening 116 is provided with weather stripping to protect the hose 153 from damage during removal through the opening 116. It is seen in FIG. 1 that a heater 154 is located on the left inner wall of the hose reel compartment 150. The heater 154 is of conventional construction and selected for provision of sufficient heat to the hose reel compartment and the water service compartment 140 via an opening in the inner longitudinal wall (not shown), to prevent water from freezing in the hose 153, in the water conduits 130, 131 and 132 and in the backflow preventer 141. In some embodiments, a water meter (not shown) is provided in-line with any one of the water conduits 130, 131 and 132 to measure water consumption.

Figure 7:
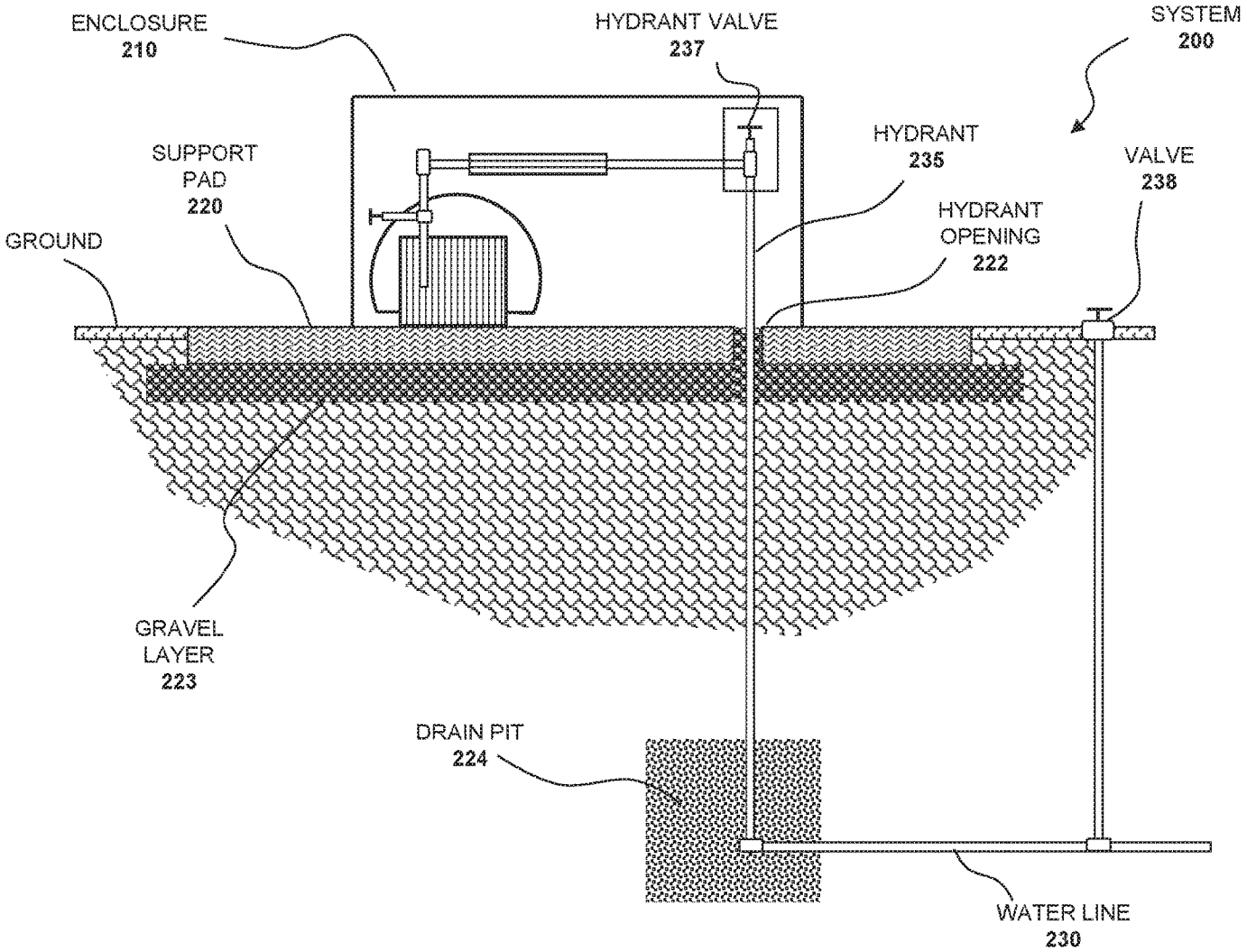
FIG. 7 is a schematic view of an outdoor water service system 200 according to another embodiment of the invention, showing the arrangement of the support pad 220, underlying gravel layer 223, drain pit 224 and secondary valve 238.
Figure 8:
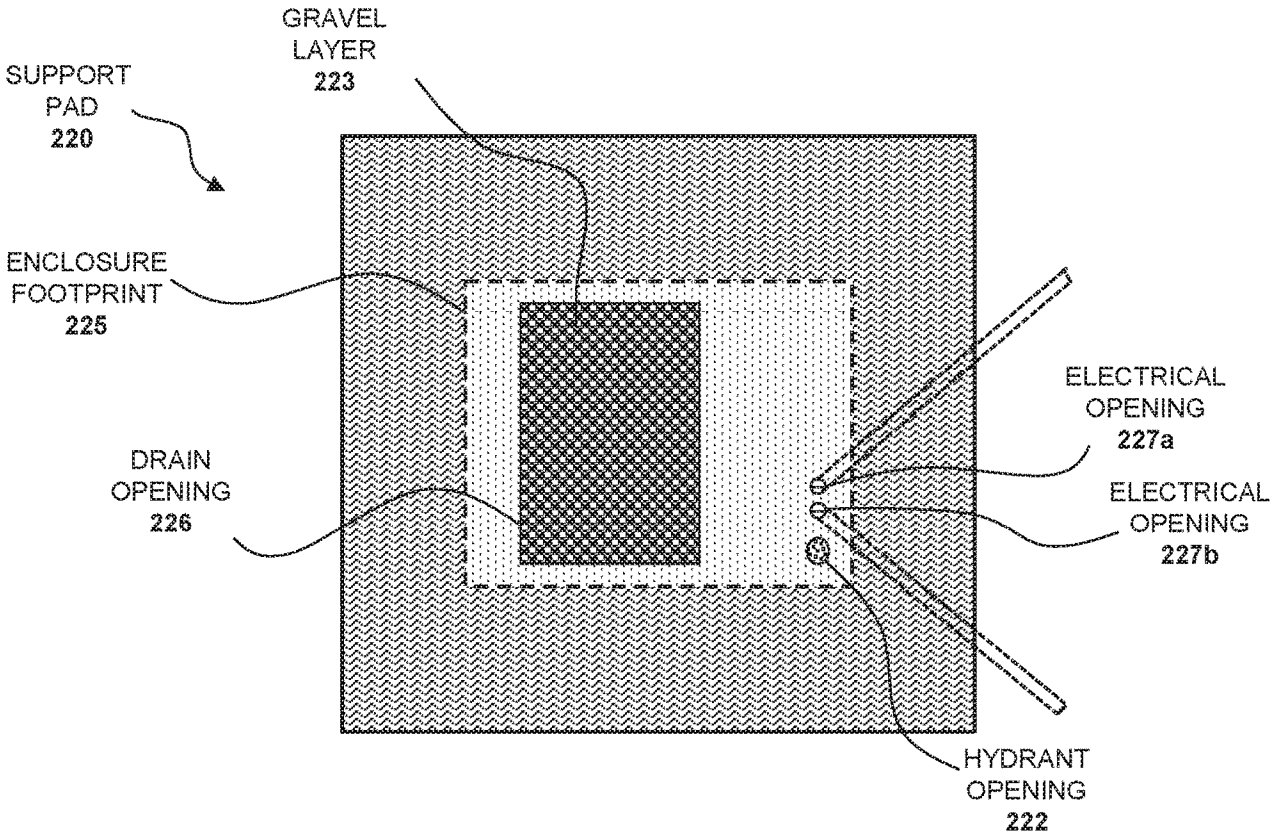
FIG. 8 is a plan view of the support pad 220 of the embodiment of FIG. 7.

As noted above, the interior of the enclosure 110 behind the water service compartment 140 is divided into two additional compartments. The third compartment is an unheated electrical compartment 160 which is a smaller compartment located to the left of the hose reel compartment 140. The electrical compartment 160 is provided to house an electrical control panel (not shown to preserve clarity) for controlling any electrical equipment that may be desired at the site of installation of the system 100. Examples of such equipment controlled by the control panel may include a water pump (particularly in situations where water pressure is low) security cameras, closed circuit television screens, floodlights, and additional heaters, which may be plugged into receptacles provided in the outer walls of the electrical compartment or inside the electrical compartment, if it is deemed that vandalism may present a problem (not shown in FIG. 1). In the particular embodiment shown, a cutout for an electrical meter 161 is provided in the left outer wall of the electrical compartment for installation of an electrical meter to facilitate monitoring of electricity consumption. Electricity is provided to the enclosure 110 via an electrical line 170 extending underground from an electrical utility provider. This is the same source of electricity used to power the heater 154 via electrical line 171. The electrical compartment 160 is accessible via a pair of doors which are not shown in FIG. 1 in order to preserve clarity, but which can be seen in the embodiment of FIGS. 2-6. While both the hydrant 135 and the electrical line 170 are shown entering through the same floor opening 111, the skilled person will appreciate that different openings may be provided for the hydrant 135 and the electrical line 170. An example of such an embodiment is shown in FIGS. 7 and 8 which will be described hereinbelow.

Another embodiment of the enclosure of the invention and portions thereof is shown in perspective views in FIGS. 2 to 6. The same reference numerals are provided to refer to components similar to those of FIG. 1.

Figure 2:
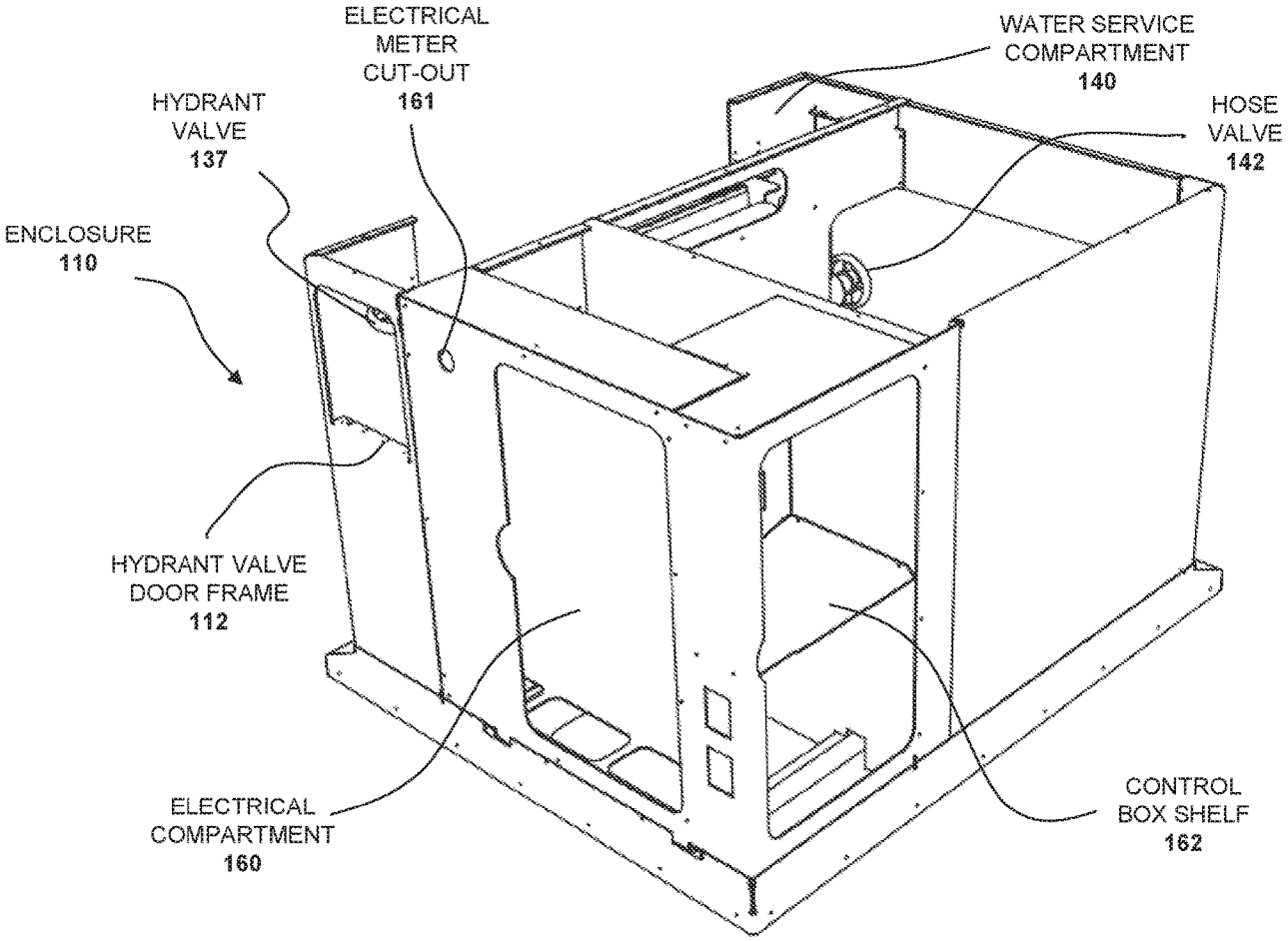
FIG. 2 is a perspective view of an embodiment of the enclosure 110 facing the electrical compartment 160 and hydrant valve door frame 112 with its top cover removed.

FIG. 2 is a perspective view facing the side of the enclosure 110 which houses the electrical compartment 160. A control box shelf 162 is seen inside the electrical compartment 160. Also shown are the hydrant valve door frame 112 and the electrical meter cut-out 161. The water service compartment 140, the hydrant valve 137 and the hose valve 142 are also visible in this perspective view.

Figure 3:
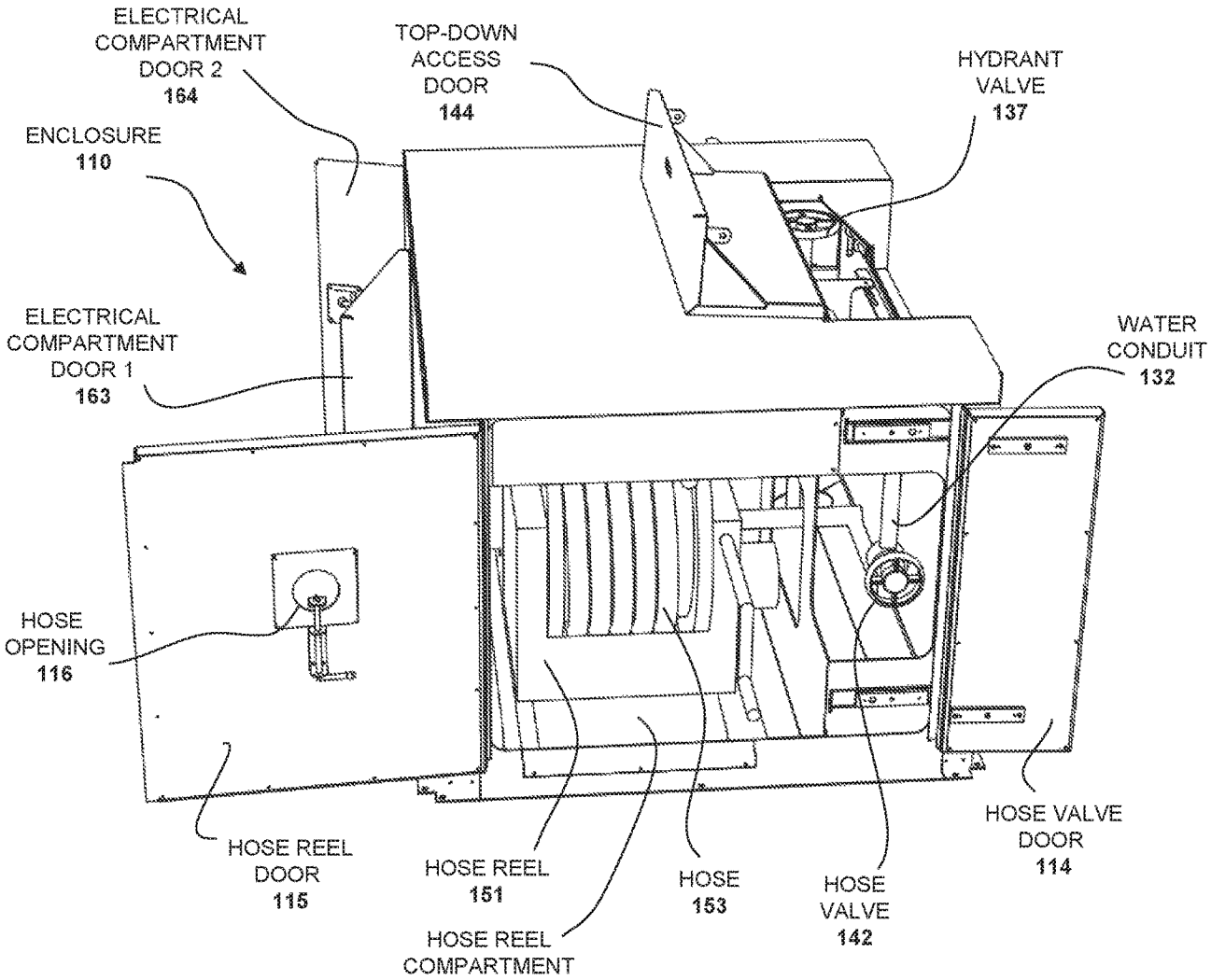
FIG. 3 is a different perspective view of the enclosure embodiment of FIG. 2, generally facing hose reel compartment 150 with the hose reel door 115 and the hose valve door 114 both opened.

FIG. 3 is another perspective view of the enclosure 110 which generally faces the hose reel compartment 150. The hose reel door 115 with the hose opening 116, hose valve door 114 the two electrical compartment doors 163 and 164 and top-down access door 144 are visible as well as the hydrant valve 137, the water conduit 132, the hose valve 142 and the hose reel 151.

Figure 4:
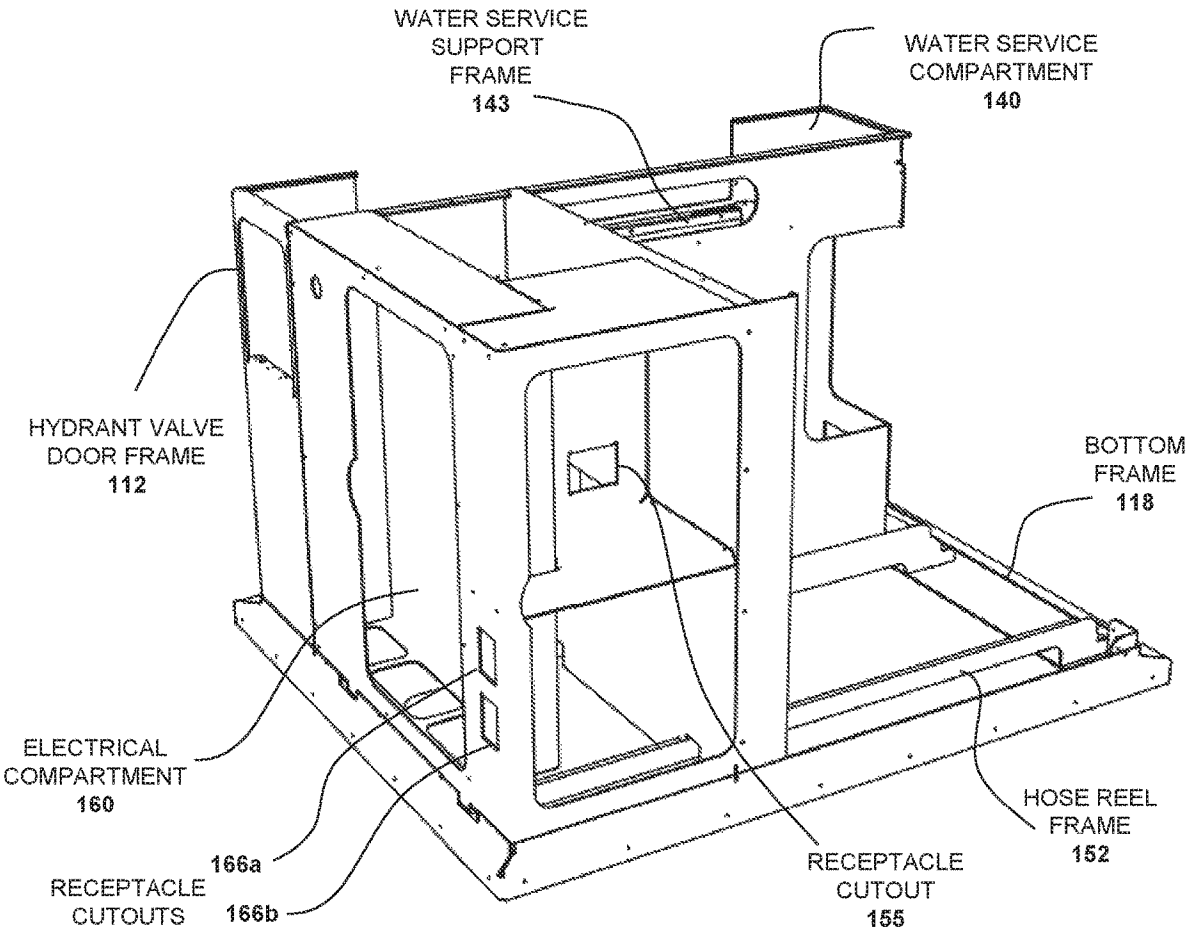
FIG. 4 is a perspective view of selected frame portions of the same enclosure embodiment of FIGS. 2 and 3, generally facing the electrical compartment 160.

FIG. 4 is a perspective view of interior frame and wall components in the same orientation of the enclosure 110 similar to that of FIG. 2, showing the bottom frame 118, as well as the walls of the water service compartment 140 and an adjustable water service support frame 143 contained therein. In one preferred embodiment, the bottom frame is formed of 3/16 inch aluminum plate sections welded together. It is seen that the hose reel frame 152 is supported by the bottom frame 118. Electrical receptacle cut-outs **166*a* and 166*b* are provided adjacent the corner of one of the walls of the electrical compartment 160. An additional receptacle cutout 155 is provided in an internal divider wall in the electrical compartment 160. It is to be understood that the structures shown in FIG. 4** are covered by outer walls formed preferably of aluminum or other lightweight metal or alloy. Advantageously in certain embodiments, the interior side of the outer walls are provided with conventional insulation for the purpose of conserving heat in the heated compartments. In some embodiments, the outer walls are coated with powdercoat or provided with a conventional sticker wrap finish.

Figure 5:
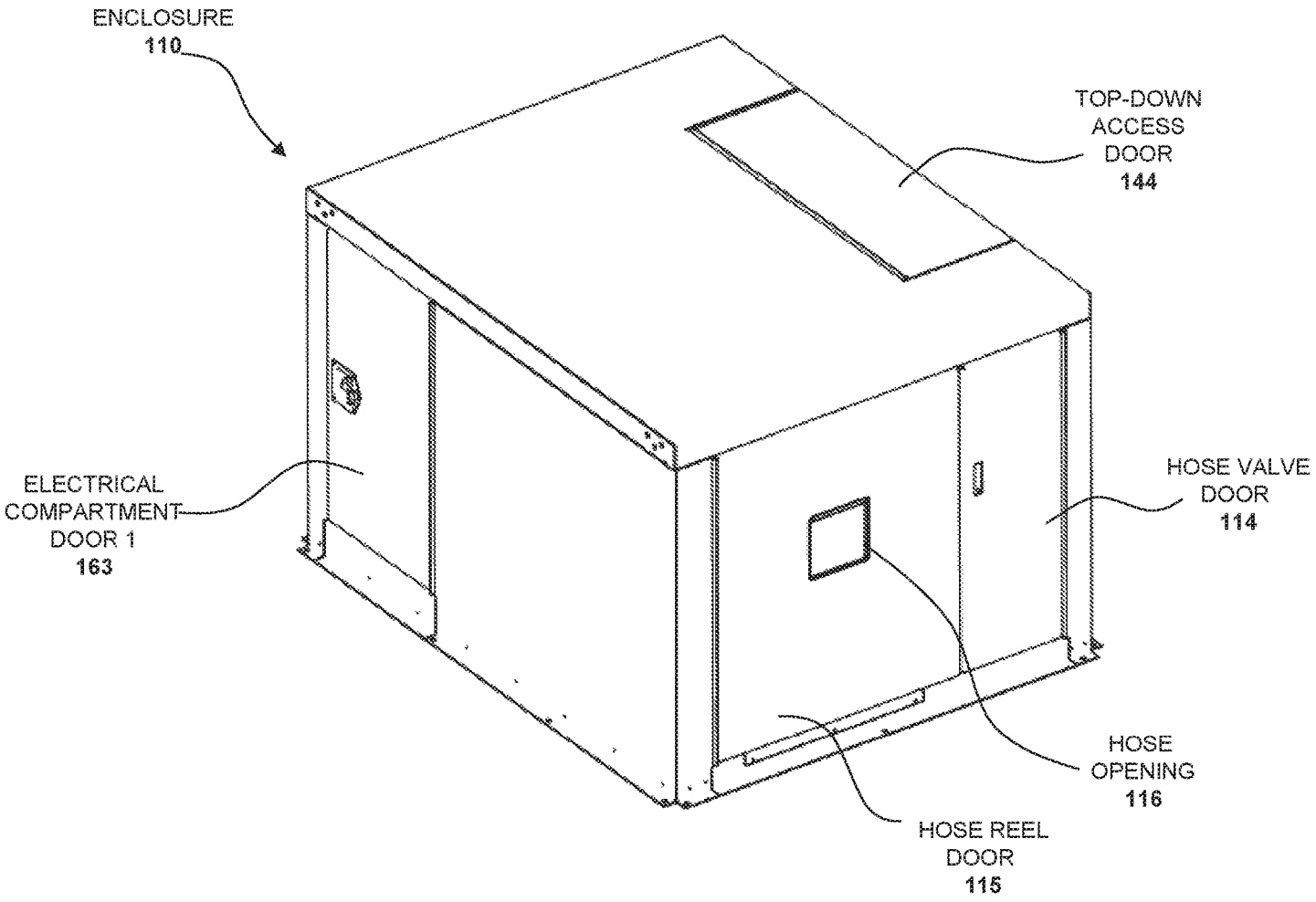
FIG. 5 is a perspective view of the enclosure embodiment of FIGS. 2-4 generally facing the hose reel door 115.

FIG. 5 is a perspective view of the enclosure 110 generally facing the hose reel door 115 and the hose valve door 114. Also shown are the top-down access door 144 and electrical compartment door 1 163.

Figure 6:
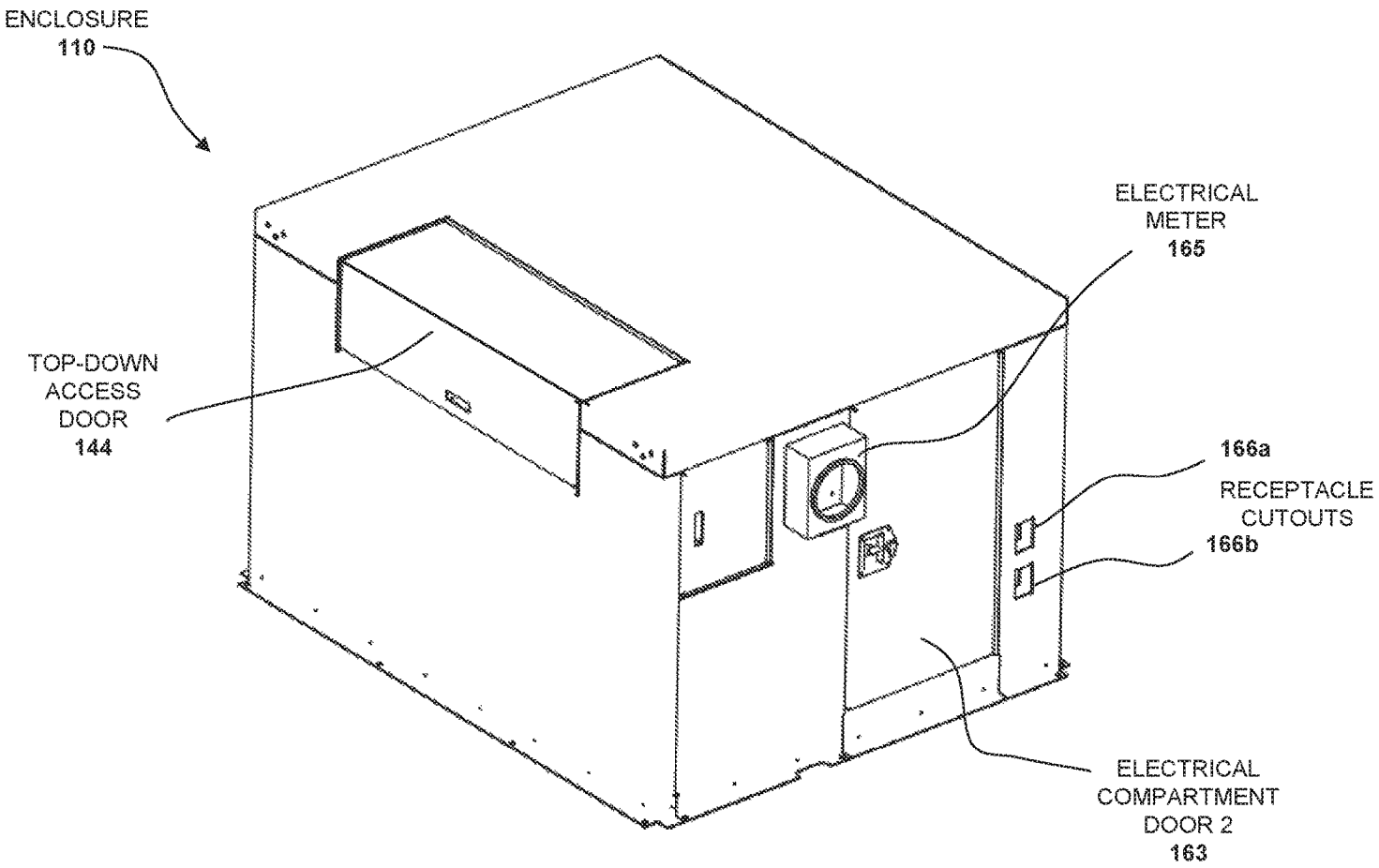
FIG. 6 is a perspective view of the same enclosure embodiment of FIGS. 2-5 generally facing the top down access door 144.

FIG. 6 is a perspective view of the enclosure 110 generally facing the top-down access door 144. Also shown are the electrical meter 165, electrical compartment door 2 163, and the electrical receptacle cut-outs **166*a* and 166*b***

FIG. 7 is a cross-sectional view of another embodiment of the system 200 which provides additional detail regarding certain peripheral features. It is seen that the enclosure 210 rests upon a support pad 220 which sits in an excavated area in the ground such that the upper surface of the support pad 220 is approximately level with the ground surface as shown. Also seen is the hydrant opening 222 for entrance of the hydrant 235 into the enclosure 210. A gravel layer 223 is added to the excavated area before the support pad 220 is placed. The system 200 also includes a drain pit 224 filled with washed gravel located at the junction of the water line 230 and the hydrant 235. A surface valve 238 is placed in the water line 230 upstream of the hydrant 235 in order to shut off water to the system 200 if required in certain circumstances.

FIG. 8 is a plan view of the support pad 220 of the system 200 shown in FIG. 7. The dashed line shows the location of the enclosure footprint 225. Inside the enclosure footprint 225 is a rectangular drain opening 226 which is filled with free draining gravel. Also within the enclosure footprint are the hydrant opening 222 and two electrical openings 227*a* and 227*b* which are provided for entrance of electrical lines into the enclosure 210.

ALTERNATIVE FEATURES AND EMBODIMENTS

A number of alternative features are now described which may added or omitted in various combinations to arrive at a number of different embodiments of the invention.

In one example embodiment, the enclosure does not include an electrical compartment because electricity may not be required in all potential applications of the enclosure. One possible example is an off-grid application of the enclosure for watering livestock in a remote area in cold weather conditions, where the water supply to the enclosure is obtained from a local body of water such as a lake or pond (with the water drawn from below the ice surface). In this embodiment, an underground water line is installed from the body of water with an underground hydrant installed near the site of installation of the enclosure. A conventional water pump may be installed in one of the heated compartments of the enclosure, such as the water service compartment, for pumping water out of the water supply to the hydrant and water lines. This is particularly advantageous if the water source generally has low pressure. The heater and pump may be powered by a DC battery or by a generator running on gasoline or diesel fuel or natural gas provided on site or through a pipeline. In other aspects, this livestock watering system operates in a manner similar to the operation described above with respect to FIG. 1. In alternative embodiments, a backflow preventer is not included because there is no danger of contaminating a municipal water utility.

In some embodiments, conventional eye hooks are provided on upper surface of enclosure for attachment of a lifting apparatus to facilitate transport of the enclosure to its site of installation. Appropriate eye-hooks are identifiable and can be installed by the skilled person without undue experimentation.

In some embodiments, the system does not include a hose reel. Instead, the hose is simply placed inside the hose reel compartment. In some embodiments, the hose is of the type that expands in circumference and length when filled with water and contracts in circumference and length when emptied of water. In such alternative embodiments, the hose is simply coiled manually and placed inside the hose reel compartment on the floor or on a wall hook or rack provided for this purpose.

In some embodiments, the control panel includes an internet connection. Electrical consumption data and water consumption data are transmitted to a central monitoring center. In some embodiments, alerts are provided to maintenance personnel by automatic text messaging or email if a power failure causes the heater to fail and the temperature drops below a pre-determined set point.

In some embodiments, one of the outer walls of the electrical compartment is provided with receptacles to allow a user to obtain general purpose access to a 120 volt current. The receptacles are controlled at the control panel and are shut off and secured during hours when the facility serviced by the system is not intended to be used.

In some embodiments, the hose reel is a powered reel which, when actuated, will spin in either direction to wind and unwind the hose automatically. Powered hose reels are known in the art and adaptable for use in embodiments of the present invention without undue experimentation.

In some embodiments, the system is permanently installed at a municipal park, for example and is used for flooding a rink in the winter and for irrigation of grass, trees and plants, or for providing water to a "splash-pad" or "spray-park" playground in the spring and summer. In converting from winter to spring/summer use, electrical power to the heater is shut off at the control panel to conserve electricity.

Other applications of embodiments of the system and enclosure include installations for irrigation, supply of water features or fire suppression at oil and gas fields and acreages.

Example 1: Operation of One Embodiment of the System

An example of operation of the system 100 with the enclosure 110 of FIG. 1 in an application for servicing an outdoor ice hockey rink at a municipal park will now be described. In this example, it is winter and a scheduled ice hockey game has just completed. A park maintenance worker is charged with the responsibility of flooding the rink after the game. This particular worker does not have access to the electrical compartment 160.

The worker unlocks and the hydrant door and opens the hydrant valve 137. This causes water to move up into the hydrant 135 and into the water conduits 130, 131 and 132 via the backflow preventer 141, all of which are located in the heated water service compartment 140. The worker then closes the hydrant door. Next, the worker moves to the other side of the enclosure 110 and opens the hose valve door 114 to turn on the hose valve 142. This allows water to flow from conduit 132 into the hose 153 which is wrapped on the hose reel 151. In most situations, the flow of water through the hose 153 is controlled at the outer nozzle 156 which at this stage, would be in the closed position, preventing flow of water therefrom. The worker then closes the hose valve door 114 and opens the hose reel door 115 to access the hose reel 151. If needed, maintenance on the hose 153 and/or the hose reel 151 can be performed. The hose reel 151 is withdrawn from the hose reel compartment 150 after raising the hose reel frame 152 to the same level as the frame of the hose reel door 115.

If the hose 153 and/or the hose reel 151 is not in need of maintenance, the worker continues with the assigned task and inserts the free end of the hose 153 through the hose opening 116 in the hose reel door 115 and closes the hose reel door 115. Heat loss from the hose real compartment 150 is minimized by the small opening 116 provided in the hose reel door 115 for the hose to pass through; and the location of the heater 154 behind the hose reel 151 which forces the heated air to circulate through the water service compartment 140. The worker proceeds to flood the rink by controlling the nozzle 156 of the hose 153.

When the flooding of the rink is complete, the worker opens the hose valve door 114, shuts off the water flow to the hose reel 151, and opens the nozzle on the end of the hose 153 to allow water to drain while re-winding the hose on the hose reel 151. Then he closes and locks the hose reel door 115. Then the hydrant door is closed and locked. At this point, water in the water line 130 flows back down to the portion of the hydrant 135 which is below the frost line, to prevent freezing of water in the underground part of the line 130 beneath the enclosure 110. This is done via a conventional hydrant drain line.

The enclosure is now secured. Any water remaining in the hose 153 the backflow preventer 140 and the water conduits 130, 131 and 132 will not freeze because the water service compartment 140 and the hose reel compartment 150 are heated by the heater 154.

Example 2: Dimensions of Components of an Example Embodiment of the Outdoor Water Service System Dimensions of selected components of one example embodiment will now be described. While specific dimensions are provided, the skilled person will recognize that significant variations from these dimensions are possible in alternative embodiments, which are also within the scope of the invention.

In this particular embodiment, the system is installed with features to minimize problems relating to freeze-thaw cycles in the ground beneath the enclosure. The enclosure itself has dimensions of 1.64 m×1.37 m×1.07 m and rests substantially centrally upon a reinforced concrete pad which is 2.84 m×2.54 m×0.15 m placed in an excavated rectangular area in the ground with a depth of 0.34 m which is partially filled to a height of about 0.19 m with washed gravel. When the pad is placed on the gravel, it is upper surface is approximately level with the ground surface. The concrete pad has a generally central rectangular opening of 1.13 m×0.75 m to allow drainage of water in the event of leakage or condensation inside the enclosure.

The area inside the central rectangular opening is filled with washed drain rock. The concrete pad is further defined by a circular inside the footprint of the enclosure adjacent to one of the corners of the enclosure. This opening is to allow passage of the above-ground portion of the hydrant through the concrete pad and into the enclosure. The concrete pad also includes openings to allow passage of electrical and ground lines through the pad and into the enclosure. In this particular example, the hydrant is 3.15 m long and a 1 $m^3$ washed gravel drain pit is placed adjacent to the bottom of the hydrant such that the water source line makes a connection to the hydrant within the drain pit. A secondary valve is placed in the water line which is controllable at the surface adjacent to the system installation, for the purpose of shutting off the water supply to the installation in the event of malfunction of the installation.

Example 3: Enclosure Product and Kit

One aspect of the invention is an enclosure product for use in assembling any one of a number of embodiments of outdoor water service systems. The enclosure product is provided by itself, without any of the functional interior components of the system. The interior components are obtained separately according to recommendations or instructions provided with the kit. The enclosure product includes at least two compartments divided by interior walls and at least two doors for accessing the interior of the compartments to manipulate functional system components contained therein, which are not included in the enclosure product.

The at least two compartments are a water service compartment and a hose reel compartment. The water service compartment is for containing functional water service components which will include at least an upper portion of a hydrant (whose lower portion is located below ground), and a water conduit leading out of the water service compartment and into the hose reel compartment which will contain a hose reel and hose. The enclosure has at least two doors for accessing interior components which are present when the system is assembled. In one embodiment, the enclosure includes a first door for accessing the upper valve of the hydrant in the water service compartment and a second door for accessing the hose reel compartment.

Alternative embodiments of the enclosure include additional doors for accessing additional system components such as a third door for accessing a backflow preventer in the water service compartment, a fourth door for accessing an electrical control panel in a third compartment (electrical component) of the enclosure, and a fifth door for accessing a hose valve in the water service compartment.

Embodiments of the enclosure product include a floor opening for entrance of the above-ground portion of the hydrant into the enclosure. Certain embodiments also include one or more additional floor openings for entrance of electrical lines into the enclosure.

Additional embodiments of the enclosure product include any combination of the interior features described hereinabove with reference to FIGS. 1 to 6.

Another aspect of the invention is a kit for assembly of an outdoor water service system. The kit comprises an enclosure as described above and instructions for assembly of one or more outdoor water service system embodiments. In some embodiments, the kit further comprises at least a hydrant configured for partial below-ground installation, a hose reel, one or more lengths of water conduit, and a heater. In some embodiments, the kit also includes a backflow preventer. In other embodiments, the kit also includes an electrical control panel for controlling a number of peripheral electronic items.

EQUIVALENTS AND SCOPE

Any patent, publication, internet site, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Unless otherwise defined, all technical and scientific terms used herein have the same meaning as commonly understood by one of ordinary skill in the art to which this invention belongs.

While this invention has been particularly shown and described with references to embodiments thereof, it will be understood by those skilled in the art that various changes in form and details may be made therein without departing from the scope of the invention encompassed by the appended claims.

The invention claimed is:

1. An outdoor water service system for use in providing a source of water via a removable hose while preventing freezing of water in the hose when the hose is stored in the system, the system comprising:

a) a source of water connected to an underground hydrant with an above-ground hydrant valve connected to the hose; and b) an enclosure comprising:

i) a first compartment with a bottom opening providing an entrance for a portion of the hydrant containing the above-ground hydrant valve, the first compartment having a first door for providing access to the hydrant valve from outside the enclosure;

ii) a second compartment containing the hose, the second compartment provided with a second door having sufficient area to allow removal of the hose from the enclosure;

iii) a heater arranged to heat at least the first and second compartments to prevent freezing of water in the hose; and iv) a third compartment containing an electrical control panel for controlling at least the heater, the third compartment having a third door for accessing the electrical control panel from outside the enclosure.

2. The system of claim 1, further comprising a backflow preventer located in the first compartment between the hydrant valve and the hose.

3. The system of claim 2, wherein the enclosure includes a fourth door for accessing the backflow preventer.

4. The system of claim 1, wherein the second door includes a hose opening allowing withdrawal of the hose from the enclosure when the second door is closed.

5. The system of claim 1, wherein the electrical control panel is configured to control one or more components selected from the group consisting of: a water pump, an outdoor light, an outdoor heater, an outdoor security camera, a public address system, an irrigation system, and an outdoor television screen.

6. The system of claim 1, wherein the enclosure is supported by a pad resting on the ground, the pad defined by an opening allowing passage of the hydrant therethrough.

7. The system of claim 1, wherein the enclosure further comprises a fifth door for accessing a hose valve controlling a flow of water into the hose.

8. The system of claim 1, wherein the hose is spooled on a hose reel.

* * * * *